United States Patent [19]

Mougin

[11] 4,193,712

[45] Mar. 18, 1980

[54] WALL FOR PROTECTING TABULAR ICEBERGS AGAINST THE MECHANICAL EFFECTS OF WAVES

[75] Inventor: Georges L. Mougin, Paris, France

[73] Assignee: ITI Limited, Paris, France

[21] Appl. No.: 899,252

[22] Filed: Apr. 24, 1978

[30] Foreign Application Priority Data

Apr. 22, 1977 [FR] France ..... 77 12180

[51] Int. Cl.[2] ..... E02B 1/00

[52] U.S. Cl. ..... 405/52; 405/28; 405/61; 405/211

[58] Field of Search ..... 61/1 R, 1 F, 5, 102; 405/21, 28, 52, 60, 61, 211

[56] References Cited

U.S. PATENT DOCUMENTS

| | | | |
|---|---|---|---|
| 3,289,415 | 12/1966 | Merrill | 61/1 R |
| 3,353,361 | 11/1967 | Lloyd | 405/28 |
| 3,599,434 | 8/1971 | Missud | 61/5 X |
| 3,906,732 | 9/1975 | Tedeschi | 61/1 F |

OTHER PUBLICATIONS

Match, Oct. 30, 1976.
Ocean Industry, Mar. 1973, pp. 28–29.

*Primary Examiner*—David H. Corbin
*Attorney, Agent, or Firm*—George E. Kersey

[57] ABSTRACT

A wall for protecting tabular icebergs against the mechanical effects of the waves and swell contains between the protective wall and the vertical side face of the tabular iceberg to be protected a layer of seawater subject to level variations of smaller amplitude than is the seawater outside said protective wall. The protective wall comprises vertical curtains parallel to the vertical side wall of the tabular iceberg to be protected. These curtains are attached to cables which maintain them in a partially submerged position, supported by gantries on the substantially horizontal upper surface of the tabular iceberg to be protected.

8 Claims, 4 Drawing Figures

WALL FOR PROTECTING TABULAR ICEBERGS AGAINST THE MECHANICAL EFFECTS OF WAVES

Figures 1, 2, 3, 4:
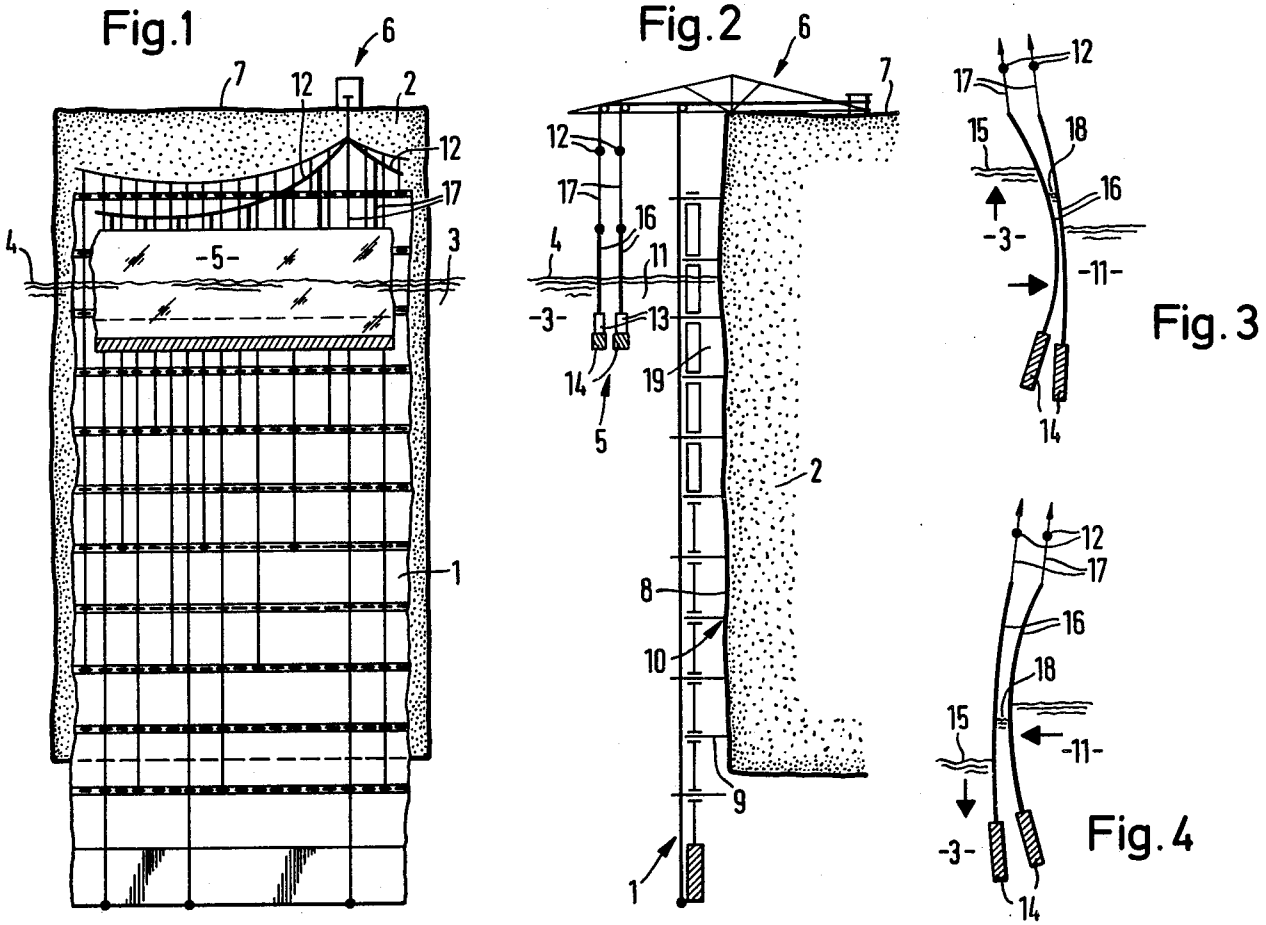

The present invention relates to protective side walls for tabular icebergs which originate exclusively in Antarctic waters. In these regions, the ice advances in the form of a plateau with a well defined frontier where it meets the sea, rather than in the form of ice tongues. The Antarctic continent is not surrounded by mountains, but is ringed by a rim of ice, part of which is supported on the continental shelf and the rest of which floats on the sea. Under the pressure of the ice inland, the rim of ice is slowly pushed towards the sea, and from time to time tabular icebergs become detached from it. These can have very large dimensions, covering an area of the order of several square kilometers, and can be towed to the offshore waters of the dry regions of the two hemispheres. However, as the journey at a speed of 0.5 meters per second from the Antarctic to the northern hemisphere lasts several months, it calls for the protection of a vertical strip extending above and below the waterline against the effects of the erosion caused by movements of the sea's surface, and the thermal insulation of the submerged parts. This protection is particularly necessary when the tabular iceberg passes through the warm seas of the tropical zone. The protection of the sides of the tabular icebergs requires the use of units of very large dimensions, for example 200 to 300 meters in height by several hundred meters in length.

It is well known that the movement of waves or of the swell can reach 15 meters above the waterline in calm waters and that water splashes can reach about thirty meters over the waterline. Consequently, it is advisable to seek to avoid continuous friction of the side wall of the tabular iceberg against the vertical faces of the protective wall by keeping the wall a certain distance away. Additionally, thermal insulation of the ice of the iceberg in warm sea-water can be suitably provided by forming areas of unrenewed calm water in the vicinity of the vertical faces of the iceberg, by means of the protective wall, so that the movement of the surface of the warm sea takes place outside the protective wall. This insulation can consist of one or two vertical layers of calm water. To form a first layer of unrenewed calm water in the vicinity of the iceberg's vertical faces, the protective wall needs to be kept a certain distance away from the iceberg's vertical faces. To form one or more additional layers of calm water, protective walls can be made with two or more sheets consisting of vertical panels parallel to the vertical face of the tabular iceberg. Additionally, an extra protection against the mechanical effect of the swell or of the waves can be obtained by placing a "mechanical" protective wall in front of the "thermal" protective wall.

The invention consists in a protective side wall for tabular icebergs, providing protection against the mechanical effects of the swell and waves, characterised in that it contains between the protective wall and the vertical side face of the tabular iceberg to be protected at least one layer of seawater subject to level variations of smaller amplitude than is the seawater outside said protective wall. In calm water, a protective wall in accordance with the invention comprises at least two parallel vertical curtains of woven or non-woven material supported on vertical suspension cables hung from caternary retaining cables attached to gantries on the substantially horizontal upper surface of the tabular iceberg to be protected. A ballast is located at the bottom edge of each of the vertical curtains, and may be supplemented by a hydraulic ballast consisting of a chamber filled with seawater and located at the bottom edge of each of the vertical curtains, to increase the inertia of the assembly.

The invention will now be described in more detail by way of example only and with reference to the accompanying drawings which show one embodiment of the invention. In the drawings:

FIG. 1 is a partial view of a tabular iceberg protected by a "thermal" side wall constructed in accordance with a technique disclosed elsewhere by the present applicants, and by a wall in accordance with the invention for protecting the iceberg against the mechanical effects of the waves and swell; FIG. 2 is a partial cross-section through a tabular iceberg, showing the wall for protecting the iceberg against the mechanical effects of the waves and swell shown in FIG. 1;

FIG. 3 and FIG. 4 are diagrammatic cross-sections through a protective wall in accordance with the invention, showing how it moves in response to variations in the level of the seawater.

FIG. 1 shows a protective wall (1) which provides thermal protection of a tabular iceberg (2) and also protects the iceberg (2) against the mechanical effects of the waves on the surface of the sea(3). Additional protection of the tabular iceberg (2) on the waterline can be provided in calm waters (4) by adding a protective wall (5) in accordance with the invention to limit the mechanical effects of the waves and swell.

The "mechanical" protective wall (5) is suspended from gantries (6) on the substantially horizontal upper surface (7) of the tabular iceberg (2). Thus the "thermal" protective wall (1) is situated between the vertical side face (8) of the tabular iceberg (2) and the "mechanical" protective wall (5), as can be seen from FIG. 2. Zig-zag spacing tubes of the "thermal" protective wall have some of their elbow bends in contact with the vertical side face (8) of the tabular iceberg. (2) In accordance with the invention, a "mechanical" protective wall (5) comprises a number of curtains (16) which, in calm water, are parallel to the vertical side face (8) of the tabular iceberg (2). As an example, FIG. 2 shows a protective wall (5) comprising two parallel vertical curtains (16) made of separate panels joined to one another. The panels are woven from filaments of a synthetic material or glass or a plastics material, and are coated with a plastics material such as PVC, Polyethylene or a fluorocarbon, and are loaded with anti-fouling materials. The curtains (16) are spaced by a horizontal distance of five to ten meters and supported by catenary suspension cables (12). There is one set of retaining cables (12) per curtain and a vertical suspension cable every five meters, attached to the retaining cable (12) and to the curtain (16).

To increase the inertia of the assembly, a large hydraulic ballast consisting of a chamber (13) filled with seawater is fitted above the conventional ballast (14). The waves or swell outside the "mechanical" protective wall (5) produce horizontal thrust loads and an increase or decrease in the level (15) of the surface of the sea (3). When the level of the seawater rises under the action of the pressure of the seawater trapped between the parallel vertical curtains (16) of the protective wall (5) in accordance with the invention and the horizontal thrust from the seawater outside the wall, the curtains (16) become curved, the curtain on the outside having a smaller radius of curvature than that next to the iceberg (2). The level (18) of the seawater contained between the curtains (16) also rises, and the ballasts (13) and (14) rise towards the surface, as shown by the arrows in FIG. 3. When the surface level drops, the ballasts (13) and (14) sink again tending to stretch the curtains (16), which again become substantially parallel to one another and to the vertical side face (8) of the iceberg (2). The seawater trapped between the curtains (16) then tends to escape at the bottom (FIG. 4), and the curtains (16) curve in the opposite sense to that observed when the surface level rises, and the seawater contained between the "mechanical" protective wall (5) and the vertical side face (8) of the tubular iceberg (2) exerts pressure on the protective wall (5). The level (18) of the seawater contained between the curtains (16) is lower than that of the seawater outside the wall (5) when the latter rises, and higher than it when it drops.

The effect of fitting a "mechanical" protective wall (5) in front of the "thermal" protective wall (1) is to create a zone (11) of clam water between the protective walls (1) and (5). This provides additional thermal protection to that provided by the layer (19) of calm water between the "thermal" protective wall (1) and the vertical side face (8) of the tabular iceberg (2).

A noteworthy feature of the invention is that the protective wall (5) is assembled flat on a horizontal working surface and then wound directly onto a floating storage and handling drum some forty meters long and fifteen to twenty meters in diameter. The suspension cables (17) are temporarily attached to one cheek of the floating drum which can be stood on end in the sea by ballasting it, with the cheek to which the cables (17) are attached out of the water. The protective wall (5) is unwound by one tug, while another tug holds the floating drum in position. The wall (5) is progressively attached to a string of floats to prevent it sinking while the suspension cables (17) are attached to the catenary retaining cables (12), the length of the cables (17) then being adjusted so as to locate the protective wall (5) in the correct position, in which it is partially submerged, to provide effective protection against the mechanical effects of the waves and swell.

The claims defining the invention are as follows:

1. A protective side structure for an iceberg, to provide protection against the mechanical effects of waves and swell, comprising a thermal protective wall for retaining a layer of sea water between it and a side face of the iceberg, and a mechanical protective wall including at least two separate curtains for retaining at least one layer of sea water between it and said thermal protective wall, subject to smaller variations in amplitude than the surrounding sea water outside the protective wall, said mechanical protective wall including ballast located at the bottom edge thereof.

2. A protective structure according to claim 1 wherein the curtains of said mechanical protective wall are supported on vertical suspension cables hung from catenary retaining cables attached to gantries on the upper surface of the iceberg.

3. A protective structure according to claim 1 wherein said ballast is hydraulic.

4. A protective structure according to claim 3 wherein the hydraulic ballast is filled with sea water.

5. A protective structure according to claim 1 where a separate ballast is associated with each curtain of said mechanical protective wall.

6. A protective structure according to claim 1 wherein said thermal protective wall is supported on vertical suspension cables hung by catenary retaining cables attached to gantries on the upper surface of the iceberg.

7. A protective structure according to claim 1 wherein said mechanical protective wall is formed from filament woven panels coated with plastic.

8. A protective structure according to claim 1 wherein the curtains of said mechanical protective wall are spaced by a horizontal distance in the range from about 5 to 10 meters.

* * * * *